US005704842A

United States Patent [19]

Petrusek

[11] Patent Number: 5,704,842

[45] Date of Patent: Jan. 6, 1998

[54] CUE STICK WITH GUIDE RIB

[76] Inventor: Paul C. Petrusek, 1207 N. 48th St., Apt. 128, Phoeniz, Ariz. 85008

[21] Appl. No.: 626,759

[22] Filed: Apr. 2, 1996

[51] Int. Cl.[6] ..... A63D 15/08

[52] U.S. Cl. ..... 473/44

[58] Field of Search ..... 473/47, 49, 44

[56] References Cited

U.S. PATENT DOCUMENTS

| | | | |
|---|---|---|---|
| 693,254 | 2/1902 | Folsom | 473/49 |
| 3,389,911 | 6/1968 | Castiglione | 473/44 |
| 5,181,718 | 1/1993 | Valentine | 473/44 |
| 5,558,584 | 9/1996 | Brown | 473/44 |

FOREIGN PATENT DOCUMENTS

| | | | |
|---|---|---|---|
| 381766 | 10/1932 | United Kingdom | 473/47 |
| 1565725 | 4/1980 | United Kingdom | 473/44 |
| 2219517 | 12/1989 | United Kingdom | 473/44 |

*Primary Examiner*—Theatrice Brown

*Attorney, Agent, or Firm*—Parsons & Goltry; Robert A. Parsons; Michael W. Goltry

[57] ABSTRACT

A cue stick adapted for table sports includes a first portion having a tenon disposed at a first end thereof. The cue stick also includes a first joint disposed at a second end thereof and a second portion having a second joint adapted to mate with the first joint disposed at a first end of the second portion and a butt disposed at a second end thereof. The first and second portions comprise an elongated conic section when joined and have the tenon disposed at a narrower end of the conic section than the butt. The cue stick includes a raised straight edge having a length less than a distance separating the first joint from the tenon and attachment means for securing the raised straight edge to the first portion on an outside surface thereof and substantially parallel to a longitudinal axis thereof.

20 Claims, 3 Drawing Sheets

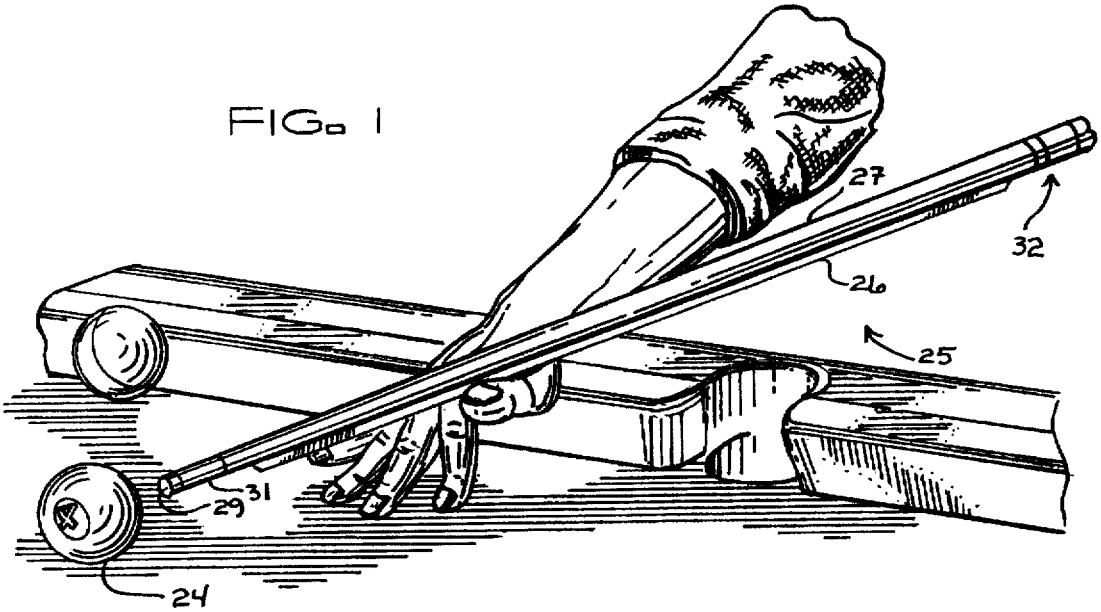
FIG. 1
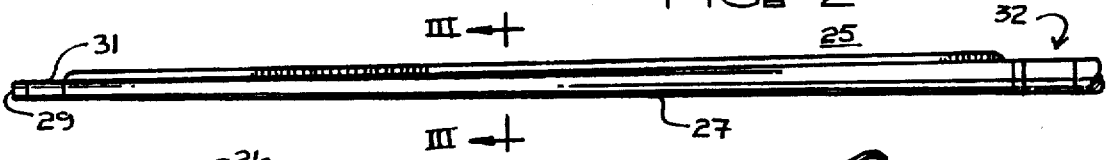
FIG. 2
FIG. 3
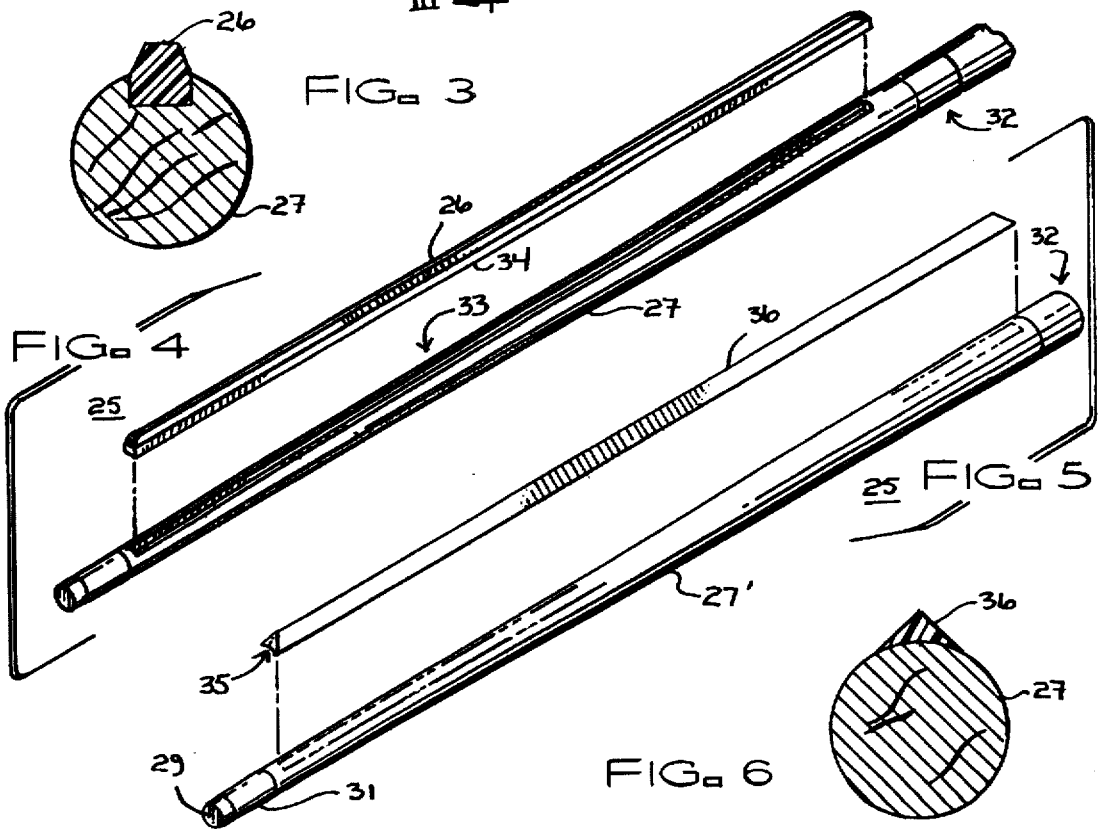
FIG. 4
FIG. 5
FIG. 6

29
31
27
26
28
45

39
38

43
31
42
41

32
48
27''
46
47
31
29

46
51

53
27
52

56
27
54

58
27'
57

61
27
59

63
27
62

72

73

CUE STICK WITH GUIDE RIB

BACKGROUND OF THE INVENTION

1. Field of the Invention

This invention generally relates to sporting equipment and leisure activities.

More particularly, the present invention relates to table games involving balls and their placement and movement on a gaming table.

In a further and more specific aspect, the instant invention concerns an apparatus for providing an improved cue stick suitable for use in playing table games including pocket billiards, pool, bumper pool, snooker and similar sports.

2. Prior Art

Cue sticks of great variety in construction and purpose are often employed in many parts of the world for table games such as, by way of example and not intended to be limiting, billiards. Some such apparatus require the sacrifice of one or more of the desirable features which cue sticks offer in order to fulfill the purpose(s) of these devices.

Cue sticks are generally desirable because they provide one or more advantages such as a well-defined and precisely delivered velocity to the ball being shot (e.g., the cue ball). However, conventional cue sticks also may at times present disadvantages such as twisting or rotating prior to and during contact with the ball being struck or shot and thus imparting sideways "English" and potentially leading to unintended skewing of ball trajectory, or, in attempting more authoritative strokes (e.g., "breaking"), providing an off-center impact on the object ball or even, in more extreme cases, unintentional jumping on impact or a jumped ball. Cue sticks also tend to be vulnerable to bending or warping. Conventional cue sticks may also represent compromise of shooting flexibility and/or accuracy. Numerous adaptations have been devised to address one or more of these deficiencies.

Various types of cue sticks and cueing aids each provide one or more benefits to remedy these shortcomings but also typically compromise at least one of the desirable features that some cue sticks offer.

For example, mechanical bridges provide improved shooting flexibility in difficult or awkward situations but at the expense of decreased control, particularly of the distal or tip end that contacts the cue ball.

A problem which has been encountered, especially by novices, stems from the difficulty in visually assessing cue stick rotation imparted unconsciously during a stroke. This is particularly true in attempting more authoritative shots and generally leads to poor reproducibility from one shot to another. It is desirable to provide the beginner with some sort of easily-recognized tactile or visual feedback in this sort of situation in order that awareness may be more readily promoted and thus enabling the initiate to more rapidly converge to command the cue stick and to progress in mastery of the game.

Further, open bridges, especially finger-tip bridges and/or mechanical bridge sticks may provide a measure of mitigation in difficult situations presenting challenging shots and permit improved visual alignment via unobstructed sighting along the length of the cue stick. However, these approaches are poorly adapted to providing control of the cue stick, particularly the tip, or of the shot. Open bridges and/or mechanical bridge sticks provide no guard against unwanted cue stick jump or cue stick rotation and are vulnerable to shooting errors including ball scratches, table scratches, jumped balls and the like for these reasons.

Accordingly, it is desirable to provide a capacity for some measure of control in the situation where an open bridge or a mechanical bridge stick and especially a raised or finger-tip open bridge is a desirable option for attempting a difficult shot.

While the various mentioned prior art devices function as apparatus for providing improved cue stick and/or shooting performance in certain situations, none provide satisfactory performance for the purpose of both general shots and more difficult shots together with aesthetic appeal and particularly combined with all of the desirable features noted hereinabove.

It would be highly advantageous, therefore, to remedy the foregoing and other deficiencies inherent in the prior art. What is needed is a cue stick apparatus of attractive appearance which provides improved alignment of, and control during, shots in a table game such as billiards and which is especially adapted to ease difficult and/or authoritative strokes or shots.

Accordingly, it is an object of the present invention to provide improvements in cue sticks for table games such as billiards.

Another object of the present invention is the provision of an improved cue stick adapted for open bridge use.

And another object of the present invention is to provide an improved cue stick which is acceptable to the rules of regular, competition and championship play of table games such as pool and billiards.

Still another object of the present invention is the provision of an improved cue stick that provides greater control over rotation of the cue stick during the stroke of a shot.

Yet another object of the instant invention is to provide a cue stick having improved resistance to warpage and/or bending.

Yet still another object of the instant invention is the provision of a cue stick capable of precisely controlled rotation for application of calibrated amounts of English in difficult shots.

And a further object of the invention is to provide a cue stick capable of delivering smoother strokes.

Still a further object of the immediate invention is the provision of a cue stick rib that does not compromise the aesthetic appearance of the cue stick to which it is affixed.

Yet a further object of the invention is to provide a rib adapted to be attached to a cue stick which allows improved visual alignment of a shot.

And still a further object of the instant invention is the provision of method and apparatus, according to the foregoing, which is intended to allow easier access and improved shooting accuracy for hard-to-reach shots when desired or necessary.

SUMMARY OF THE INVENTION

Briefly stated, to achieve the desired objects of the instant invention in accordance with a preferred embodiment thereof, provided is a cue stick including a first portion having a tenon disposed at a first end and a first joint disposed at a second end and including a shaft disposed therebetween. The cue stick also includes a second portion having a second joint adapted to mate with the first joint, the second joint disposed at a first end of the second portion. The cue stick further includes a butt disposed at a second end of the second portion.

The first and second portions form an elongated conic section when joined and have the tenon disposed at a narrower end of the conic section than the butt. The cue stick includes a raised straight edge having a length less than a distance separating the first joint from the tenon. The cue stick also includes attachment means for securing the raised straight edge to the first portion on an outside surface thereof and substantially parallel to a longitudinal axis thereof.

The cue stick desirably but not essentially includes a a female dovetail groove extending longitudinally along the shaft from a first position near the tenon to a second position proximal to the first joint. The first and second positions are usefully separated by a distance comparable to a length of the raised straight edge. The raised straight edge desirably includes a lower portion including a male dovetail adapted to fit the female dovetail groove of the shaft.

A cue stick adapted for table sports forms an elongated conic frustum, including a butt disposed at a first end and a tenon disposed at a second end. The cue stick further includes a shaft disposed between the butt and the tenon. The shaft comprises a tapered cylindrical conic section adapted to fit human hands, a raised straight edge and an attachment coupling the raised straight edge to the shaft substantially along or substantially parallel to a longitudinal axis. The coupling may be effected through glue, dado joints, dovetail joints or glue in combination with any of several types of joints.

The cue stick desirably but not essentially further includes a ferrule attached to and surrounding the tenon and a tip secured to a distal end of the ferrule. The tip is adapted to striking a cue ball.

The attachment of the raised straight edge to the shaft desirably but not essentially further includes a multiplicity of grooves disposed at substantially right angles to a dado groove disposed on the shaft and a similar multiplicity of circlips. Each of the multiplicity of circlips is disposed in one of the multiplicity of grooves and is adapted to firmly engage a lower portion of the raised straight edge when the raised straight edge is inserted into the dado groove.

BRIEF DESCRIPTION OF THE DRAWINGS

The foregoing and further and more specific objects, features and advantages of the instant invention will become readily apparent to those skilled in the art from the following detailed description of preferred embodiments thereof taken in conjunction with the drawings in which:

FIG. 1 is a sketch of a ribbed cue stick being employed to make a shot in accordance with the teachings of the instant invention;

FIG. 2 is a sketch showing a side view of a cue stick having the rib of FIG. 1; FIG. 3 depicts an enlarged side view, in section, taken along section lines III—III of FIG. 2, of the shaft of the cue stick of FIGS. 1 and 2, illustrating a shape of a first preferred embodiment of the rib thereof;

FIG. 4 illustrates a detailed exploded view of the rib and cue stick of FIGS. 1 through 3, showing a first embodiment of the rib and an attachment of the rib to the shaft of the cue stick;

FIG. 5 is a sketch depicting detailed an exploded view of the rib and cue stick of FIGS. 1 and 2, showing a second preferred embodiment of the rib and the attachment of the rib to the cue stick;

FIG. 6 depicts an enlarged side view, in section, taken along section lines III—III of FIG. 2, of the shaft of the cue stick of FIGS. 1 and 2, illustrating a shape of a first preferred embodiment of the rib thereof;

DETAILED DESCRIPTION OF THE PREFERRED EMBODIMENT

Figures 7, 8, 9, 10, 11, 12, 13, 14, 15, 16:
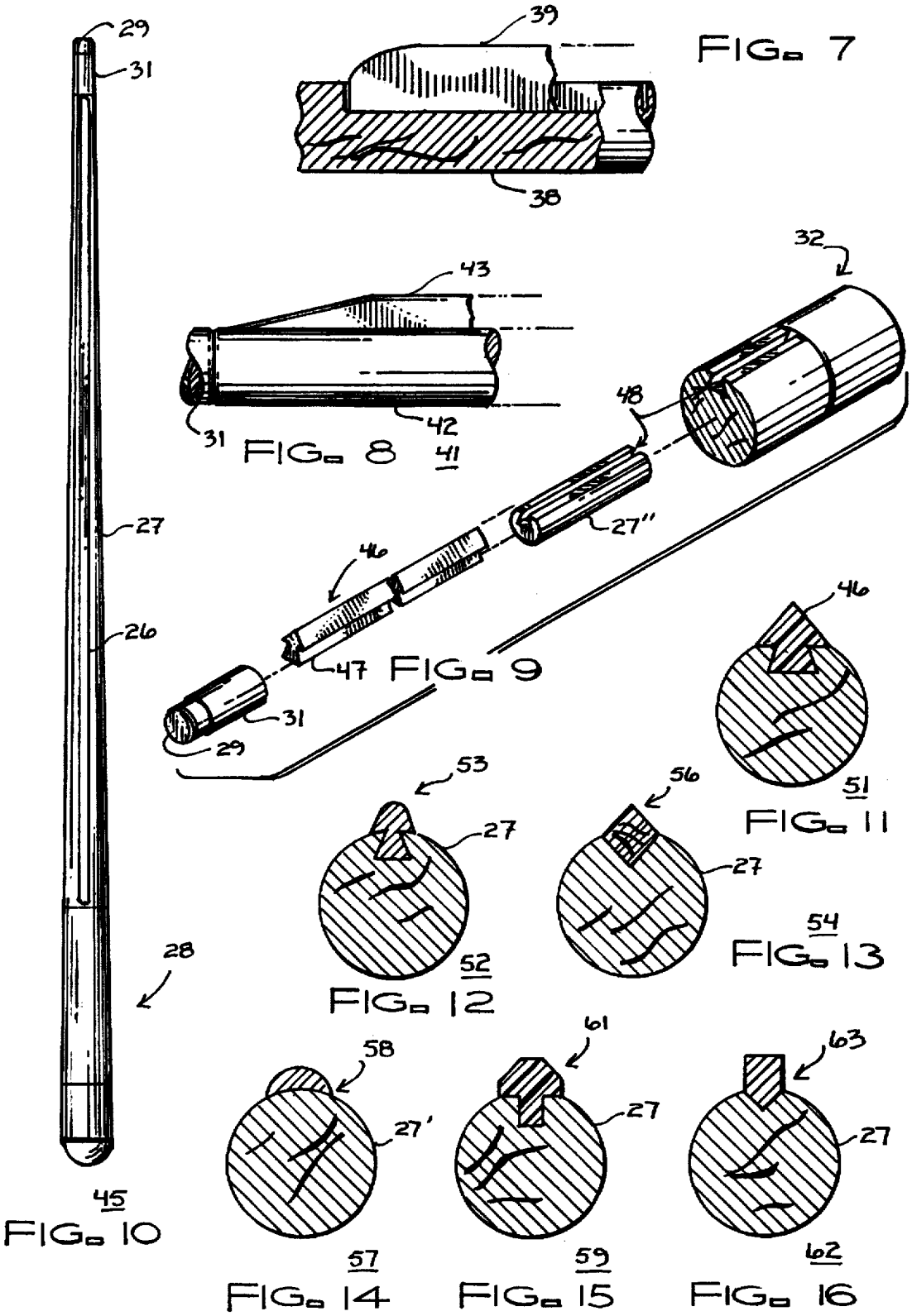
FIG. 7 illustrates a portion near the tip of the cue stick of FIGS. 1 through 4, providing a detailed and enlarged longitudinal sectional view of a first embodiment of the distal end of the rib thereof.
FIG. 8 depicts a portion near the tip of any of the cue sticks of FIGS. 1 through 6, providing a detailed and enlarged view of a second embodiment of the distal end of the rib.
FIG. 9 is an illustration showing a series of portions of the cue stick and the rib of FIGS. 1 and 2, illustrating assembly of the cue stick, tip and rib.
FIG. 10 is a sketch showing a plan view of another preferred embodiment of the cue stick and rib of FIGS. 1 through 4.
FIG. 11 is a sketch depicting an enlarged side view, in section, taken along section lines III—III of FIG. 2, of the shaft of the cue stick and the raised straight edge of FIGS. 1 and 2, illustrating a shape of an embodiment of the raised straight edge thereof.
FIG. 12 is a drawing providing an enlarged side view, in section, taken along section lines III—III of FIG. 2, of the shaft of the cue stick and the raised straight edge of FIGS. 1 and 2, showing a shape of another embodiment of the raised straight edge thereof.
FIG. 13 is an illustration of an enlarged side view, in section, taken along section lines III—III of FIG. 2, of the shaft of the cue stick and the raised straight edge of FIGS. 1 and 2, depicting a shape of a further embodiment of the raised straight edge thereof.
FIG. 14 depicts an enlarged side view, in section, taken along section lines III—III of FIG. 2, of the shaft of the cue stick and the raised straight edge of FIGS. 1 and 2, illustrating a shape of a yet further embodiment of the raised straight edge thereof.
FIG. 15 provides an enlarged side view, in section, taken along section lines III—III of FIG. 2, of the shaft of the cue stick and the raised straight edge of FIGS. 1 and 2, providing a shape of a still further embodiment of the raised straight edge thereof.
FIG. 16 shows an enlarged side view, in section, taken along section lines III—III of FIG. 2, of the shaft of the cue stick and the raised straight edge of FIGS. 1 and 2, including a shape of a yet still further embodiment of the raised straight edge thereof.

Turning now to the drawings, in which like reference characters indicate corresponding elements throughout the several views, attention is first directed to FIG. 1 which illustrates a ribbed cue stick in accordance with the teachings of the instant invention and generally designated by the reference character 25. In accordance with the configuration chosen for purposes of illustration, FIGS. 1 and 2 depict jointed cue stick 25 in a perspective view in play and in a side view, respectively, while FIGS. 3, 4 and 5, 6 illustrate different attachment modes for two distinct types of raised straight edges 26 and 36, respectively, to jointed cue sticks 25.

Cue sticks such as cue stick 25 typically comprise an elongated conic frustum adapted to fit human hands, having a tip 29 adapted to striking a cue ball 24. The tip 29 is disposed at a narrower end of the elongated conic frustum via a ferrule 31 coupled to a tenon (not illustrated) and includes a butt, usually weighted, disposed at a wider end of the elongated conic frustum.

FIG. 1 is a sketch of a ribbed cue stick 25 being employed to shoot a cue ball 24 from a finger tip open bridge in accordance with the teachings of the instant invention. The raised straight edge 26 fits into the "tiger's mouth" (i.e., the joint area between the thumb and index finger) of the hand and is securely maintained in that position. This warrantees cue stick 25 against unwanted rotation, jump, wobble and other undesirable phenomena that might adversely affect play when the tip 29, secured to a ferrule 31 at a distal end of the shaft 27, contacts the cue ball 24 to effect play. The ferrule 31 is usually secured to the end of the shaft via a tenon (not illustrated).

FIG. 2 is a sketch showing a side view of a cue stick 25 having the raised straight edge 26 of FIG. 1 affixed to the shaft 27 of the cue stick 25. The raised straight edge 26 extends longitudinally from a first position near the ferrule 31 to a second position near the joint 32 located between the forward and rear components of the cue stick 25. The raised straight edge 26 extends along the portion of the cue stick 25 normally engaged with and played in the bridge during the course of even an authoritative shot (e.g., during breaking).

The rib 26 generally forms a raised straight edge disposed along the length of a portion of the cue stick 25, located in accordance with the line of center or longitudinal axis with respect to the cue stick 25.

Conventional cue sticks of the continuously circular and tapered design approximated by an elongated conic frustum and suitable for adaptation to include the rib 26 are available from a variety of commercial sources, including Altamonte Billiard Factory and Viking Cue Manufacturing, Inc. Cue sticks are sold through vendors including Golden West Billiard supply and Service, Inc. of Canoga Park, Calif.

As used herein, the terms "elongated conic frustum", tapered cylindrical conic section", "shaft" "continuously circular and tapered" and "elongated conic section" are used interchangeably and are defined to mean an elongated shaft usefully adapted to fit human hands and having one end larger than another, with any of a variety of cross-sectional shapes including oval, cardiod or other shapes and which may vary in cross-sectional area along the length thereof in any fashion.

As used herein, the terms "rib" and "raised straight edge" are used interchangeably and are defined to mean a substantially straight linear feature distinct from and raised with respect to a primary shaft or other body. The Rib 26 or raised straight edge 26 usefully extends a distance outward from the surface of the shaft of less than an inch, desirably less than one-half inch and preferably about one-fourth of an inch but other distances, greater or smaller, may be usefully employed in accordance with the shape thereof and/or the needs, requirements and preferences of the user of the cue stick 25. Turning now to FIGS. 3 and 4, a first preferred embodiment of the cue stick 25 of FIGS. 1 and 2 having the raised straight edge 26 longitudinally affixed thereto is described.

Referring now to FIG. 3, an enlarged side view is depicted in section, taken along section lines III—III of FIG. 2, of the shaft 27 of the cue stick 25 of FIGS. 1 and 2, illustrating a bevelled rectangular shape of a first preferred embodiment of the rib 26 thereof. This shape makes for a robust engagement with the bridge and secures the cue stick 25 against unwanted rotation and/or jump which could adversely affect a shot.

FIG. 4 illustrates a detailed exploded view of the raised straight edge 26 and cue stick 25 of FIGS. 1 through 3, showing a first embodiment of the rib 26 and the attachment of the raised straight edge 26 to the shaft 27 of the cue stick 25. A lower portion 34 of the rib 26 is rectangularly shaped and is adapted to fit into a dado groove 33 extending longitudinally along the shaft 27 for a length substantially equal to that of the rib 26. The raised straight edge 26 may be held in the dado groove 33 by gluing, for example. Alternatively, other attachment techniques (e.g., screws, brads, tacks et cetera) may be employed or these may be employed in combination with gluing.

FIGS. 5 and 6 and associated text describe a second preferred embodiment of the cue stick 25 of FIGS. 1 and 2 in detail.

FIG. 5 is a sketch depicting detailed an exploded view of a raised straight edge 36, having a substantially triangular cross-sectional shape (see FIG. 6), and the cue stick 25 of FIGS. 1 and 2, showing a second preferred embodiment of the rib 36 and the attachment of the raised straight edge 36 to a shaft 27' analogous to the shaft 27 of the cue stick 25.

FIG. 6 depicts an enlarged side view, in section, taken along section lines III—III of FIG. 2, of a shaft 27' analogous to the shaft 27 of the cue stick 25 of FIGS. 1 and 2, illustrating a triangular shape of another preferred embodiment of the rib 36. The raised straight edge 36 includes a concave or quasi-cylindrical lower surface adapted to attachment to the shaft 27'. One advantage of the rib 36 of FIGS. 5 and 6 is that the raised straight edge 36 may be attached to an existing cue stick (for example, by gluing) to provide a cue stick 25 having a rib 36 attached thereto without need to resort to machining of the cue stick itself.

Of course, it will be appreciated that raised straight edges 36 having different cross-sectional shapes than that illustrated in FIG. 6 may be employed (for example, see FIGS. 11 through 16 and associated text, infra) provided that a lower surface 35 of the rib 36 is adapted to accommodate the shape of the shaft 27' of the cue stick 25.

If desired, a group of the ribs 36 may be rendered interchangeable or rapidly field-changeable through use of attachment methods, materials and techniques lending themselves to purposes of this variety (e.g., Velcro™).

Referring now to FIGS. 7 and 8, detailed views of several embodiments of a terminal end of the raised straight edges 26 or 36 of the cue stick 25 of any of FIGS. 1 through 6 are illustrated, showing different shapes to which a terminal end of the rib 26 or 36 may be adapted.

FIG. 7 illustrates a portion 37 near the tip 29 and the ferrule 31 of the cue stick 25 of FIGS. 1 through 4, providing a detailed and enlarged longitudinal sectional view of one embodiment 37 of the distal end 39 of the rib 26 and the cue stick 25. The embodiment 37 illustrated in FIG. 7 is suited to a raised straight edge 26 similar to those which are depicted in FIGS. 1 through 4 because it allows for graceful accommodation of variations in the depth of the groove 33

(see FIG. 4), thickness of a bead of glue employed to attach the rib 26 to the shaft 27 of the cue stick 25 or in variations in the height of raised straight edge 26 or combinations of the preceding.

FIG. 8 depicts a portion 41 near the tip 29 and the ferrule 31 of any of the cue sticks 25 of FIGS. 5 and 6, providing a detailed and enlarged view of another embodiment 41 of the distal end 43 of the rib 36 that is particularly well adapted to the arrangement of the raised straight edge 36 illustrated in FIGS. 5 and 6.

A short taper, as shown in the portion 41 of FIG. 8, when associated with the distal end 43 of FIG. 8 securing the rib 36 to the terminus 42 of the shaft 27, provides the full advantages of the raised straight edge 36 of FIGS. 5 and 6 in situations such as, by way of example, shooting at cue balls that are frozen to the rail, are frozen to or kissing other balls in play or are located in situations providing crowded shots (e.g., such as masse shots). In these and other situations, the range of motion available to the player is extremely limited and the required degree of control is acute.

FIG. 9 is an illustration showing a series of portions 44 of a cue stick 25 such as that of FIGS. 1 and 2, illustrating assembly and relative positions of the cue stick 25, the tip 29, the ferrule 31 and the rib 46, wherein the raised straight edge 46 and the shaft 27" are secured one to the other via a dovetail type of joint. The male dovetail 47 of the rib 46 mates with the female dovetail 48 of the shaft 27" to provide an exceptionally strong type of joint, particularly when accompanied with glue.

Those of skill in the art will appreciate that the embodiments described in FIGS. 1 through 9 and associated text illustrate raised straight edges 26, 36 and 46 attached to a forward component of a jointed cue stick 25. This forward portion of a cue stick 25 is thinner than a rearward component (not illustrated in FIGS. 1 through 9) and so is more vulnerable to bending and warpage and benefits more from the additional shear strength, rigidity and substance provided through the addition of ribs such as raised straight edges 26, 36 and 46 than does the rear portion (not illustrated in FIGS. 1 through 9), which is typically thicker and therefore sturdier. Jointed cue sticks 25 have the advantages of being readily disassembled by unscrewing joint 32 (see FIGS. 1, 2, 4, 5 and 9, supra) to enable ready stowage of the disassembled cue stick 25 in a convenient carrying case (not illustrated) and are generally well adapted to providing portability of the cue stick 25. Jointed cue sticks 25 are generally preferred in situations where portability is desirable.

FIG. 10 is a sketch showing a plan view of a cue stick 45 analogous to the cue stick 25 illustrated in FIGS. 1 through 9, but of the non-jointed variety. In this embodiment, the rib 26 may extend longitudinally along a greater extent of the shaft 27, from a region near the tip 29 and the ferrule 31 towards and even approaching the butt 28 of the cue stick, as is illustrated. Nonjointed cue sticks 45 are usually found in settings where portability of the cue stick 45 is not an issue.

Attention is now drawn to FIGS. 11 through 16, illustrating, in cross-section, a series of alternative embodiments of the ribs 26 and/or 36 and of the cue sticks 25 and/or 45 of FIGS. 1 through 10.

FIG. 11 is a sketch depicting an enlarged side view, in section, taken along section lines III—III of FIG. 2, of a portion 51 of the shaft 27 of the cue stick 25 of FIG. 9, for example, illustrating the triangular shape of the embodiment of the raised straight edge 46 thereof and also showing the relative placement of the male dovetail of the rib 46 within the female dovetail of the shaft 27 to provide a strong, durable joint.

FIG. 12 is a drawing providing an enlarged side view, in section, taken along section lines III—III of FIG. 2, of a portion 52 of the shaft 27 of the cue stick 25 of FIGS. 9 and 11, showing a raised straight edge 53 having a shape of another embodiment 53 of the rib 46 of FIGS. 9 and 11 together with a dovetail fitting between shaft 27 and rib 53. Shape 53 is shown as having a rounded outer profile in cross-section, rather than being beveled (see FIG. 3, supra) or triangular (see FIGS. 5, 6 and 9, supra), potentially allowing for greater lateral freedom of motion within the bridge than the shape of the raised straight edge 26 shown in FIG. 3 and/or providing greater comfort and latitude in shooting, among other things.

FIG. 13 is an illustration of an enlarged side view, in section, taken along section lines III—III of FIG. 2, of a portion 54 of the shaft 27 of the cue stick 25 of FIGS. 1 and 2, depicting a shape 56 that has a triangular outer profile in cross-section (see FIG. 6), of a further embodiment of the rib 26 thereof in association with a triangular groove type of attachment.

FIG. 14 depicts an enlarged side view, in section, taken along section lines III—III of FIG. 2, of portion 57 of the shaft 27' of the cue stick 25 of FIGS. 5 and 6, illustrating a shape 58 having a rounded outer profile in cross-section (see FIG. 12), of a yet further embodiment of the rib 36 thereof and employing a quasi-cylindrical concave lower surface for attachment to the shaft 27'.

FIG. 15 provides an enlarged side view, in section, taken along section lines III—III of FIG. 2, of a portion 59 of the shaft 27 of the cue stick 25 of FIGS. 1 and 2, providing a shape 61, having a rectangular-with-beveled-edges outer profile in cross-section (compare to FIG. 3), of a still further embodiment of the raised straight edge 26 thereof in association with a dado groove type of attachment.

FIG. 16 shows an enlarged side view, in section, taken along section lines III—III of FIG. 2, of a portion 62 of the shaft 27 of the cue stick 25 of FIGS. 1 and 2, including a shape 63, having a rectangular outer profile in cross-section, of a yet still further embodiment of the rib 26 thereof in association with a triangular groove type of attachment.

It will be appreciated that any of shapes 46, 53, 56 58, 61 and 63 (and others) may be associated with attachments of the dado (see FIGS. 3 and 15), dovetail (see FIGS. 9, 11 and 12), triangular groove (see FIGS. 13 and 16) and rounded bottom or concave types (see FIGS. 5, 6 and 14) and others, not illustrated, in order to accommodate particular needs in accordance with the advantages of each particular type of raised straight edge 26, 36, 46, 53, 56 58, 61 and 63 in combination with the benefits of each particular type of attachment.

Each type of rib 26, 36, 46, 53, 56 58, 61 and 63 may suit a particular individual's needs and desires while different types of attachment may suit the materials employed, the manufacturing capabilities available and the desired degree of reinforcement deemed applicable to a particular cue stick 25 or 45 in application in a designated scenario in accordance with a variety of factors. For example, the shapes of rib 61 (see FIG. 15), rib 63 (see FIG. 16) and rib 26 (see FIGS. 1 through 3) provide relatively robust engagement of the raised straight edges 61, 63 or 26 with the bridge, while the shapes of rib 53 (see FIG. 12) or rib 58 (see FIG. 14) may provide greater comfort for some players.

Referring now to FIGS. 17 through 20, details of cue stick 25 are illustrated, showing yet another attachment technique for securing a raised straight edge 66 to the shaft 27 of the cue stick 25.

Figure 17:
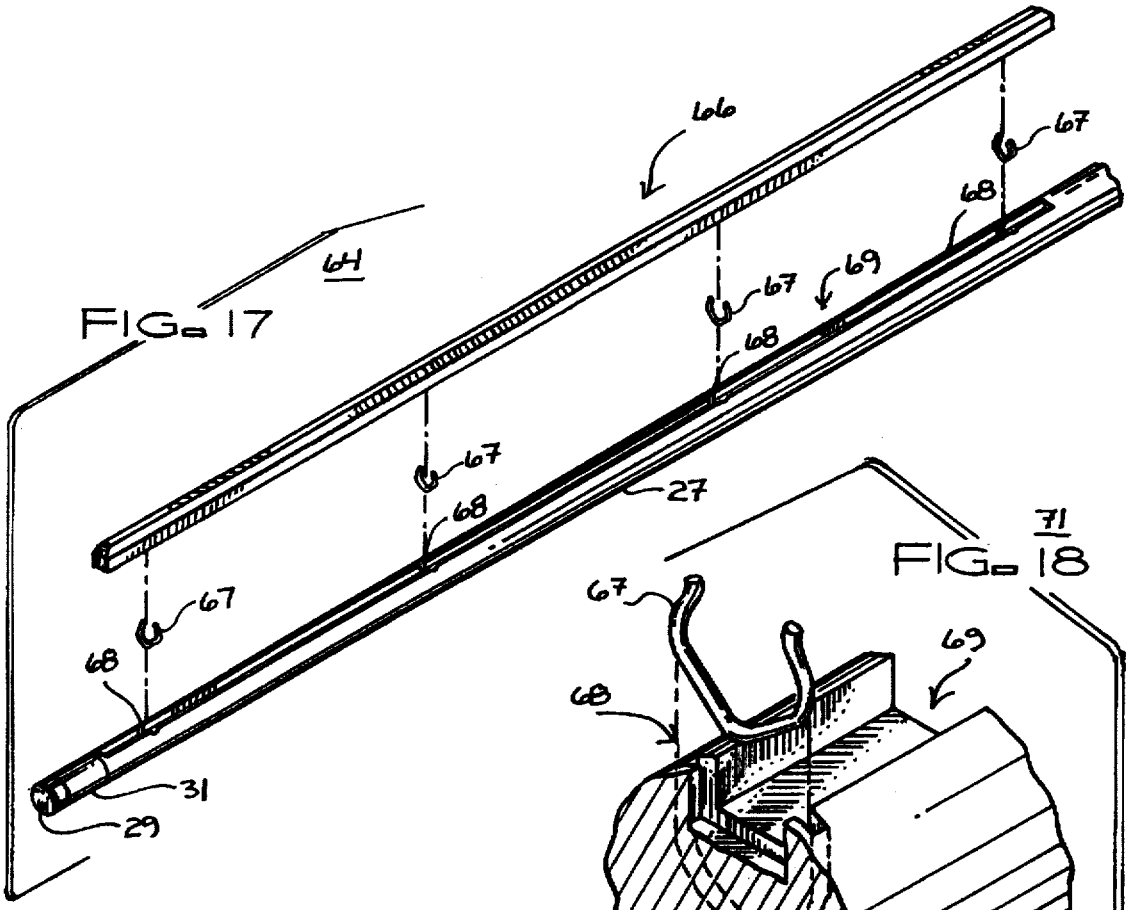
FIG. 17 is an illustration showing an isometric view of another embodiment of the cue stick of FIGS. 1, 2 and 10, depicting yet another attachment technique for securing the rib to the shaft of the cue stick.

FIG. 17 is an illustration showing an isometric view 64 of the cue stick 25, depicting yet another attachment technique for securing the rib 66 to the shaft 27 of the cue stick 25 comprising a raised straight edge 66 having a shape generally adapted to accommodate a dado type of groove 69 in the shaft 27 of a cue stick 25. The rib 66 is adapted to be secured within the dado groove 69 via circlips 67 ensconced within grooves 68 distributed along the length of the dado groove 69. This arrangement provides for ready removal of a particular raised straight edge 66 and substitution of another, for example, a rib 66 featuring the profile of any of the raised straight edge shapes illustrated in FIGS. 11 through 16, supra.

Figure 18:
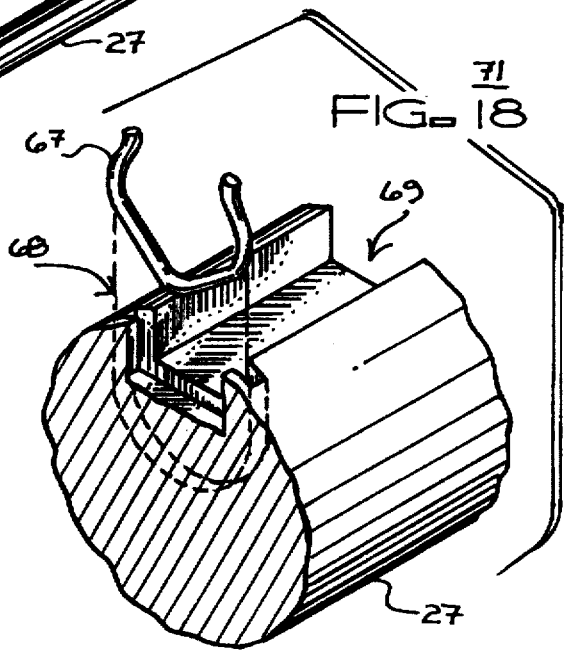
FIG. 18 illustrates an enlarged isometric cross-sectional view of the cue stick of FIG. 17, showing the circlip and cue stick in detail.

FIG. 18 illustrates an enlarged isometric cross-sectional view of a portion 71 of the cue stick 25 of FIG. 17, showing the circlip 67, one of the grooves 68 relative to the dado groove 69 and cue stick shaft 27 in detail. The circlip 67 becomes engaged with the groove 68 by moving the circlip 68 along the path shown by the broken lines to provide the arrangement sketched in FIG. 19.

Figure 19:
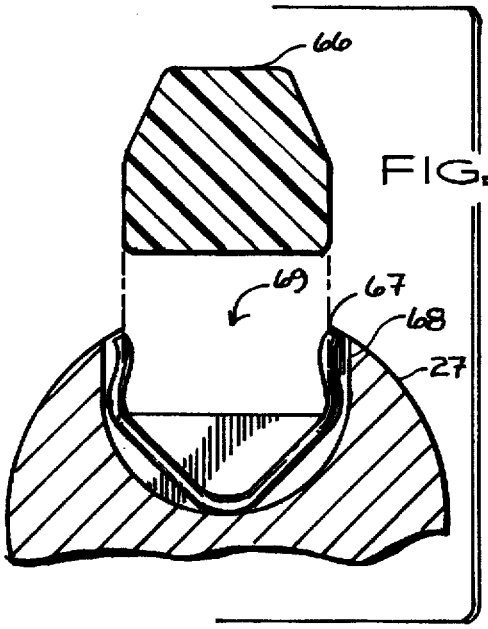
FIG. 19 depicts a further enlarged cross-sectional exploded view of a portion of the embodiment of the cue stick of FIGS. 17 and 18 and the rib of FIG. 17.

FIG. 19 depicts a further enlarged cross-sectional exploded view of a portion 72 of the embodiment of the cue stick 25 of FIGS. 17 and 18 and the rib 66 of FIG. 17. The circlip 67 is contained within the groove 68 and is ready to receive the rib 66 for installation, resulting in the ribbed cue stick portion 73 illustrated in cross-section in FIG. 20.

Figure 20:
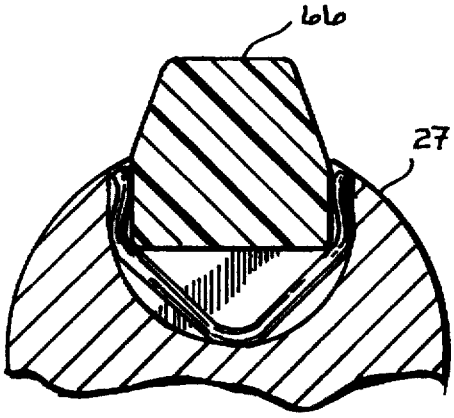
FIG. 20 depicts a further enlarged cross-sectional view of a portion of the embodiment of the rib of FIGS. 17 and 19 mounted on the shaft of the cue stick of FIGS. 17 through 19.

FIG. 20 depicts a further enlarged cross-sectional view of a portion 73 of the embodiment of the raised straight edge 66 of FIGS. 17 and 19 mounted on the shaft 27 of the cue stick 25 of FIGS. 17 through 19. The rib 66 has been engaged in the dado groove 69 and is firmly maintained in that position by circlips 67 grasping a lower portion of the rib 66. This arrangement promotes ready interchange of raised straight edges 66 having differing profiles as discussed above in connection with FIG. 17 and also accommodates ready replacement of the rib in the event that replacement is necessary through breakage of the rib 66, for example.

It will be appreciated that other physical arrangements of these components are possible without compromise of the functionality thereof and that the specific embodiment may include, for example, more or fewer shaft sections (i.e., for a jointed cue stick) and may accommodate additional functions as well. For example, a shaft having a cross-sectional area comprising lenticular, tear-drop, heart-shaped, regular and/or irregular polygon shape or combinations or variations thereof may provide a cue stick having a raised straight edge or rib in accordance with the present invention.

The apparatus described herein thus provides a ribbed cue stick. This apparatus also provides a variety of rib shapes and attachment techniques substantially as described herein and illustrated in the accompanying drawings.

A subtle advantage of this type of cue stick 25 in competition play derives from both the distinctive appearance coupled with the benefits provided in shooting ease and accuracy. The futuristic appearance of the cue stick 25 in combination with skillful play may be advantageously employed to affect the other party's nerve in the course of the game, analogous to the techniques employed so effectively by Bobby Fisher in his international chess matches.

The apparatus of the instant invention is adapted for table games including bumper pool, billiards, pocket billiards, snooker and the like. Persons who are novices derive benefits of improved control and repeatability together with improved visual alignment and improved tactile feedback. The instant invention allows such persons to converge more rapidly towards shooting competency. Persons of skill at the game benefit from improved control, smoother stroke and psychological advantages in competition play, while reducing the risk of table scratches, jumped balls and other hazards of the game.

The foregoing detailed description of the several embodiments of the instant invention for the purposes of explanation have been particularly directed toward the application as cue stick, for example, for providing a wooden cue stick such as a wooden cue stick employing different wood materials and grains to improve structural stability against temperature and weather (e.g., moisture) effects, flexural strength and aesthetic appeal. This is equally effective for sticks formed from other materials such as plastics, fiberglass, etc. It will be appreciated that the invention is equally useful for altering the weight distribution of jointed and unjointed cue sticks, aluminum and fiberglass cue sticks and other apparatus related to table games.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A cue stick adapted for table sports, said cue comprising:

an elongated conic frustum including a butt disposed at a first end and a tenon disposed at a second end and further including a shaft disposed therebetween, said shaft comprising a tapered cylindrical conic section adapted to fit human hands;

a raised straight edge separate from said shaft; and attachment means coupling the entire length of said raised straight edge to said shaft along a longitudinal axis thereof.

2. The cue stick adapted for table sports as claimed in claim 1, wherein there is further included:

a ferrule attached to said tenon and enclosing said tenon; and a tip secured to a distal end of said ferrule, said tip adapted to striking a cue ball.

3. The cue stick adapted for table sports as claimed in claim 1, wherein:

said raised straight edge includes a lower portion of generally rectangular cross-section; and said shaft includes a longitudinal dado groove adapted to accommodate said lower portion of said raised straight edge.

4. The cue stick adapted for table sports as claimed in claim 3, wherein said attachment means comprises glue.

5. The cue stick adapted for table sports as claimed in claim 3, wherein said attachment means further includes:

a multiplicity of grooves disposed at substantially right angles to said dado groove of said shaft; and a similar multiplicity of circlips, each of said multiplicity of circlips disposed in one of said multiplicity of grooves and adapted to firmly engage said lower portion of said raised straight edge.

6. The cue stick adapted for table sports as claimed in claim 1, wherein:

said shaft comprises wood; and said raised straight edge comprises wood.

7. The cue stick adapted for table sports as claimed in claim 1, further comprising:

a female dovetail groove extending longitudinally along said shaft from a first position near said tenon to a second position, said first and second positions being separated by a distance comparable to a length of said raised straight edge; and wherein said raised straight edge includes a lower portion comprising a male dovetail adapted to fit said female dovetail groove of said shaft.

8. The cue stick adapted for table sports as claimed in claim 1, wherein said raised straight edge further includes a lower portion having a quasi-cylindrical concave shape adapted to receive a portion of said elongated conic frustum extending from a first position near said tenon to a second position more remote from said tenon.

9. The cue stick adapted for table sports as claimed in claim 8, wherein said attachment means includes glue disposed between said lower portion having a quasi-cylindrical concave shape and said portion of said elongated conic frustum.

10. The cue stick adapted for table sports as claimed in claim 1, wherein said elongated conic frustum comprises:

a joint disposed between said butt and said tenon, said joint detachably dividing first and second portions of said elongated conic frustum and enabling said first and second portions to be detachably coupled together or separated; and wherein said raised straight edge extends from a first position proximal to said tenon to a second position proximal to said joint.

11. The cue stick adapted for table sports as claimed in claim 1, wherein said raised straight edge includes an outer profile substantially triangular in cross-section.

12. The cue stick adapted for table sports as claimed in claim 1, wherein said raised straight edge includes an outer profile substantially rectangular in cross-section.

13. The cue stick adapted for table sports as claimed in claim 12, wherein said raised straight edge includes a rectangular outer profile having bevelled edges.

14. The cue stick adapted for table sports as claimed in claim 1, wherein said raised straight edge includes an outer profile substantially rounded in cross-section.

15. A jointed cue stick adapted for table sports, said jointed cue stick comprising:

a first portion having a tenon disposed at a first end thereof and a first joint disposed at a second end thereof;

a second-portion having a second joint adapted to mate with said first joint disposed at a first end of said second portion and a butt disposed at a second end thereof, said first portion and said second portion comprising an elongated conic section when joined and having said tenon disposed at a narrower end of said conic section than said butt;

a rib separate from said shaft and having a length less than a distance separating said first joint from said tenon; and attachment means for securing the entire length of said rib to said first portion on an outside surface thereof and substantially parallel to a longitudinal axis thereof.

16. The jointed cue stick adapted for table sports as claimed in claim 15, wherein there is further included:

a ferrule attached to said tenon and enclosing said tenon; and a tip secured to a distal end of said ferrule, said tip adapted to striking a cue ball.

17. The jointed cue stick adapted for table sports as claimed in claim 16, wherein said attachment means further comprises:

a female dovetail groove extending longitudinally along said shaft from a first position near said tenon to a second position near said first joint, said first and second positions being separated by a distance comparable to a length of said rib; and wherein said rib includes a lower portion comprising a male dovetail adapted to fit said female dovetail groove of said shaft.

18. The jointed cue stick adapted for table sports as claimed in claim 17, wherein said rib includes an outer profile including bevelled edges.

19. The jointed cue stick adapted for table sports as claimed in claim 15, wherein said attachment means comprises glue.

20. The cue stick adapted for table sports as claimed in claim 15, wherein said attachment means further includes:

a multiplicity of grooves disposed at substantially right angles to said dado groove of said shaft; and a similar multiplicity of circlips, each of said multiplicity of circlips disposed in one of said multiplicity of grooves and adapted to firmly engage said lower portion of said rib.

* * * * *